US006729890B2

(12) United States Patent
Shin

(10) Patent No.: US 6,729,890 B2
(45) Date of Patent: May 4, 2004

(54) REDUCED-SIZE BOARD-TO-BOARD CONNECTOR

(75) Inventor: Hee Seok Shin, Ansan (KR)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/465,980

(22) PCT Filed: Dec. 28, 2001

(86) PCT No.: PCT/US01/49837

§ 371 (c)(1),
(2), (4) Date: Jun. 27, 2003

(87) PCT Pub. No.: WO02/054540

PCT Pub. Date: Jul. 11, 2002

(65) Prior Publication Data

US 2004/0063344 A1 Apr. 1, 2004

(30) Foreign Application Priority Data

Dec. 29, 2000 (KR) ..... 2000/85681

(51) Int. Cl.[7] ..... H01R 13/00
(52) U.S. Cl. ..... 439/74; 439/862
(58) Field of Search ..... 439/74, 862, 660, 439/66, 65

(56) References Cited

U.S. PATENT DOCUMENTS 5,181,855 A * 1/1993 Mosquera et al. ..... 439/74
5,599,192 A * 2/1997 Olson ..... 439/65
5,803,752 A 9/1998 McHugh ..... 439/74
5,836,855 A * 11/1998 Eschenbach ..... 482/57
5,975,916 A * 11/1999 Okura ..... 439/74
6,024,582 A 2/2000 Wu ..... 439/74
6,071,129 A 6/2000 Konno et al. ..... 439/74
6,159,021 A * 12/2000 Kusuhara ..... 439/74
6,276,942 B1 * 8/2001 Hsiao ..... 439/74
6,379,191 B1 * 4/2002 Goetz et al. ..... 439/660
6,390,828 B1 * 5/2002 Yamaguchi et al. ..... 439/74
6,540,529 B1 * 4/2003 Yu ..... 439/74
6,638,078 B2 * 10/2003 Hashiguchi et al. ..... 439/66

FOREIGN PATENT DOCUMENTS

EP 0 717 463 A2 6/1996 ..... H01R/9/09

OTHER PUBLICATIONS

EP Search Report for PCT/US01/49837.

* cited by examiner

*Primary Examiner*—Alexander Gilman
(74) *Attorney, Agent, or Firm*—Thomas D. Paulius

(57) ABSTRACT

A board-to-board connector assembly for connecting two printed circuit board is disclosed and includes interengaging plug and receptacle connectors that each have terminal-receiving cavities with conductive terminals disposed therein. Each of the terminals includes a tail portion that extends out of its respective connector for attaching the terminal to a circuit on the circuit board, and an elastic contact portion for contacting an opposing terminal of a mating connector. The elastic contact portion of the receptacle connector is bent at least twice upon itself to form a "Z" shape and to have plural elastic curved portions. An end of the elastic contact section is bent enward to form a contact face. The plug connector terminals have convex contact portion extending from their associated tail portions. The convex contact portion resiliently protrudes out of the plug connector and is located between the lower elastic curved portion and the contact portion of the connector pin, and an upper surface of the convex contact portion is in contact with a lower surface of the contact portion, when the connector housing and the assembling body are assembled together. In connector assemblies of the present invention, the convex contact portions of the plug connector are not separated from engagement with the receptacle connector terminals, even when an abrupt impact is applied from the exterior, so that contact stability and contact force for an electric connection between the connector terminals are improved.

12 Claims, 6 Drawing Sheets

REDUCED-SIZE BOARD-TO-BOARD CONNECTOR

BACKGROUND OF THE INVENTION

The present invention relates generally to board-to-board connectors, and more particularly to a connector assembly for connecting two circuit boards together and which prevents the two connector components from being separated from each other after they are engaged together, to thereby improve the stability of contact and a contact force between the contacts of the connectors.

As is generally known in the art, a printed circuit board ("PCB") is a thin board on which chips or other electronic devices are installed. The printed circuit board is typically made from a fiberglass, and devices mounted on the board are electrically connected to each other through one or more circuits formed from copper on the circuit board. In the industry, the main circuit board in a system is called the main board or "motherboard", and secondary circuit boards that are connected to the main board are called "daughter" boards or edge cards. Individual electronic parts were connected to each other on circuit board of the 1960's, while in the 1990's; a plurality of chips, each of which contains several ten to several million basic electronic devices, are commonly connected to each other.

In manufacturing of the circuit boards described above, a thin copper plate is first placed on a substrate made from fiberglass or plastic, and then is covered by a photoresist solution. Light is shined on the photoresist through a negative film on which a circuit is printed, and hardens portions of the photoresist coating that correspond to the circuit and which remain even after etching of the circuit board. Thereafter, the etched substrate board is passed through an electrolyte solution containing strong acid, so that the rest of the portion which is not hardened, washes away. This process completes the printed circuit on the boar The predesigned circuit pattern permits electronic devices to be soldered, or otherwise attached, to the circuit board.

FIG. 1 illustrates, in sectional view,; a conventional board-to-board connector assembly assembled together and connecting two circuit boards 14*a*, 14*b* together. The connector assembly includes a first connector 6, typically referred to as a "plug" connector that is received within a recess, or chamber 4, that is formed at a center of a housing 2 of a second connector, typically referred to in the art as a "receptacle" connector. For this construction, sidewalls 8 are formed at both sides of the connector housing 2, and conductive terminals 10 are fixed to the sidewalls 8, while a set of opposing conductive terminals 12 are disposed in the body of the first, or plug, connector 6. The receptacle connector housing 2 is fixed to one circuit board 14*a* at one side, while the plug connector body 6 is fixed to a second circuit board 14*b* on its other side.

Each of the receptacle terminals 10 has a tail portion 10*a* for mounting to the circuit board and a contact portion 10*b* integrally connected thereto, and is bent twice upon itself so as to define two curved portions 10*c* and 10*d* that extend vertically in the contact portion 10*b*, and a convex contact face 10*e* is formed at a distal end of the contact portion 10*b*. Each of the plug connector terminals 12 has a vertical contact portion 12*e* that opposes the convex contact face 10*e*, which substantially has a shape similar to the symbol "∂", so that a tail portion 12*a* of the plug connector terminal is located at an upper position in opposition to the circuit board 14*a*.

However, in the case of the plug terminal having the above type of construction, when the contact portion loses elasticity due to an a external impact, the contact portion may not, maintain its contact with the convex contact face, thereby causing a problem of defective contact. Furthermore, another problem occurs in that the contact portion of the plug pin and the convex contact face 10*e* of the receptacle terminal 10 may be easily separated from each other by an external impact, since there its construction is not capable of securing reliable contact between the contact portions of the plug connector terminals and the convex, contact faces of the receptacle connector terminals.

The present invention is directed to a connector assembly that overcomes the afore mentioned disadvantages

SUMMARY OF THE INVENTION

Accordingly, it is a general object of the present invention to provide a connector assembly for connecting together two printed circuit boards in a manner which prevents the two connectors from easily being separated each other after they are assembled together.

Another object of the present invention to provide a connector assembly for connecting, two circuit boards together, the connector assembly including first and second mating connectors, and in which the terminals of the first connector have contact portions which are resilient in both vertical and horizontal directions so as to improve the contact force between the mating terminals of the two connectors.

It is a further object of the present invention to provide a connector assembly for connecting together two circuit boards, in which the terminals of the two connectors that make up the connector assembly can be elastically deformed, so as to improve the stability of the mating contact between the two connectors and the contact force between the two connector terminals.

Yet another object of the present invention is to provide an improved board-to-board connector assembly for connecting two circuit boards together, the connector assembly, including a receptacle connector and a plug connector, each of the two connectors having a plurality of conductive terminals, the terminals of the two connectors having configurations which reduces the overall height of the connector assembly and which can be fixed to each other, without the need to form a separate locking structure in the insulative housings, of either of the two connectors.

A still further object of the present invention is to provide a board-to-board connector assembly having a receptacle connector that mates with an opposing plug connector, one of the connectors having a plurality of conductive terminals with a "Z" shape, or configuration, the terminal configuration reducing the overall height of the connector assembly and increasing the retention force that retains the two connectors together.

In order to accomplish these and other objects and advantages, the present invention includes in its preferred embodiment, a connector assembly for connecting together two printed circuit boards that includes a first connector having a housing for attachment to a first one of the two printed circuit boards and a second connector having a housing for attachment to the second one of the two printed circuit boards, one of the two connectors preferably being of the receptacle style and the other of the two connector preferably being of the plug style, the plug connector fitting within the receptacle connector when the two connectors are engaged together.

The first connector housing may be a receptacle-style connector, and as such, includes a base plate with sidewalls disposed at opposite sides of the base plate to form a receiving chamber, or receptacle, in the center of the -base plate, each of the sidewalls having a plurality of holes disposed therein that each receive a single conductive terminal. Each of the receptacle connector terminals preferably includes a tail section that extends out of the connector housing for attaching to the one circuit board, and an elastic contact section extending from the tail portion section within the receptacle of the connector housing, the elastic contact section being bent at least twice so as to have a plurality of elastic curved portions, the elastic contact section further having a free end with a tip thereof end bent inward to form a curved, or convex, contact face of the terminal portion. The tail section of the receptacle connector terminals extend outside of the housing sidewalls when they are inserted into the receptacle connector housing, while the contact sections thereof extend within the connector housing.

The second connector housing is of the plug-style and include a central body portion that extends from a base plate that is attached to a second circuit board. The central body portion of the plug-style connector is received within the receptacle of the receptacle housing and a plurality of conductive terminals are mounted on the plug connector central body portion. Tail sections of these terminals extend out of the body portion for attaching the plug connector to the second circuit board, while contact sections extend from the tail sections along the body portion in opposition to the terminals of the receptacle connector.

The plug connector terminals each have a curved, or convex contact face that extends outwardly and is disposed between two inclined extents of the terminals so that it may deflect, or be elastically deformed in the horizontal direction when the plug connector is inserted into the receptacle connector. The convex contact faces of the plug connector tennis pin are located between two inclined extents of the terminals so that upper surfaces of the terminal contact sections are in contact with the contact face of the receptacle connector terminals when the plug and receptacle connectors are assembled together.

It is preferred that the convex contact faces of the plug connector terminals are flanked by at least one inclined surface, so that the plug terminals may be easily and elastically deformed in horizontal and vertical directions by the receptacle connector terminals when the plug and receptacle connector housings are assembled together, so that the convex contact faces of the plug connector terminals slide over and along the contact portion faces of the receptacle connector terminals.

These and other objects, features and advantages of the present invention will be clearly understood through a consideration of the following detailed description.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Figure 1:
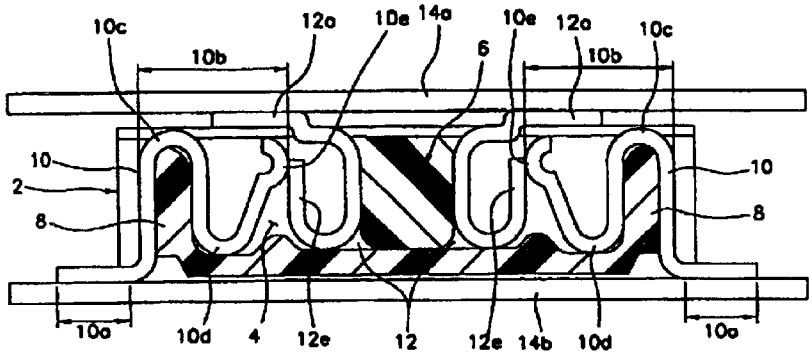
FIG.1 PRIOR ART
FIG. 1 is a sectional view of a conventional board-to-board connector assembly for connecting together two printed circuit boards.
Figure 2:
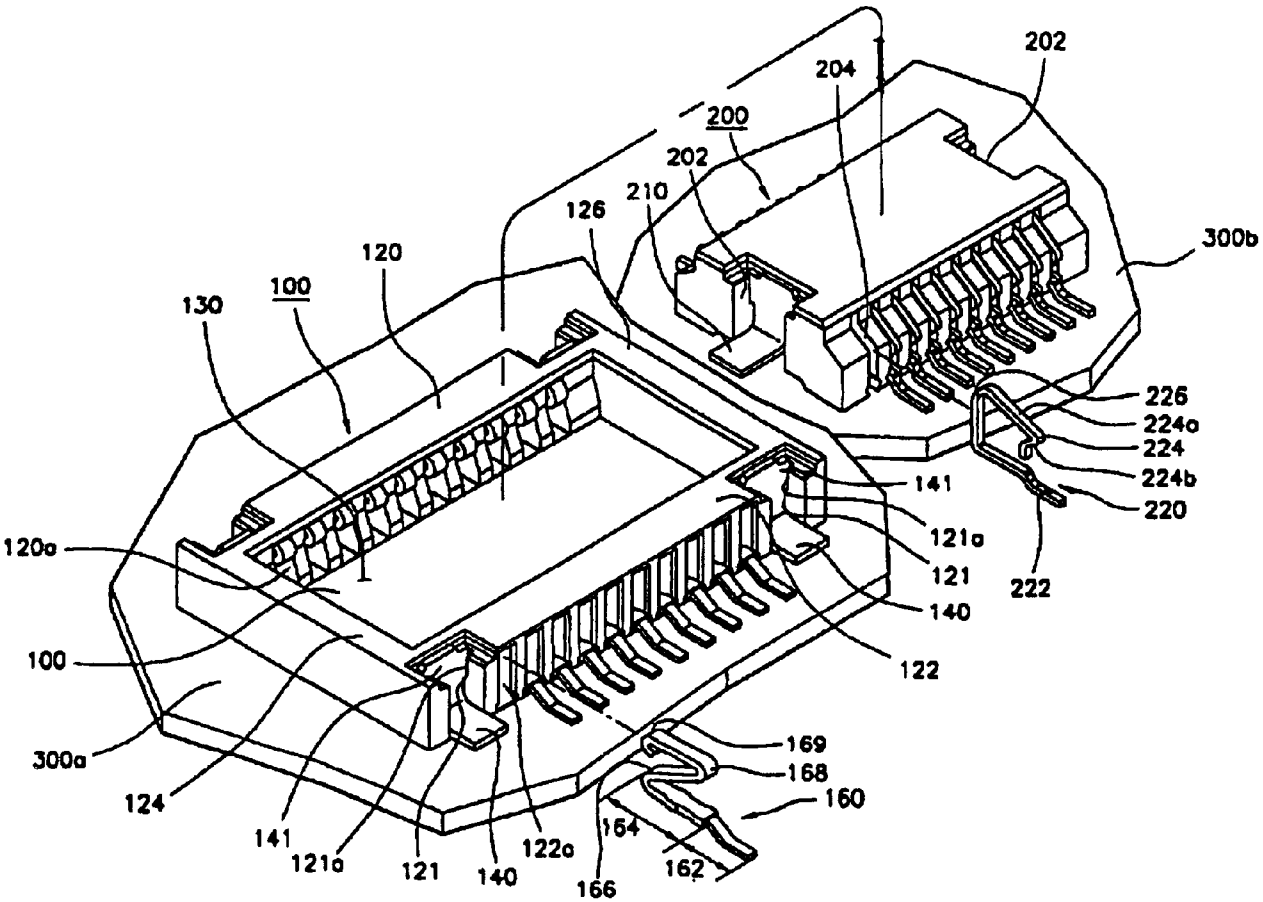
FIG. 2 is an exploded perspective view of a connector assembly constructed in accordance with the principles of the present invention, and with the connectors aligned with each other.

FIG. 2 is an exploded perspective view of a board-to-board connector assembly constructed in accordance with the principles of the present invention that is useful for connecting two printed circuit boards together. The connector assembly includes a first connector 100 that is attached to a first circuit board 300*a*, and a second, opposing mating connector 200 that-is attached to a second circuit board 300*b*.

The first connector includes an insulative connector housing 100 having a pair of lengthwise sidewalls 120 and 122 that are interconnected by a pair of endwalls 124 and 126 and, which all preferably rise up from a housing base plate 110 to cooperatively define a receiving chamber, or receptacle 130, that is centrally disposed in the first connector housing. The first connector housing includes a plurality of openings, or cavities, 120*a* and 122*a* disposed in side-by-side order in the housing sidewalls 120, 122 and are preferably aligned with each other in opposition for the length of the connector 100. Another set of cavities, or grooves 121, may be formed in the sidewalls 120, 122 and may be provided with holding slots 121*a* These grooves 121 receive first holding tabs 140 that have a general "L" shape as illustrated in FIG. 2 and which fit by way of an interference fit between retention ends 141 formed at both sides of one end of the first holding tabs 140. The retention ends jaws 141 fit into the first slots 121*a*, while the other, lower end of the first holding tab 140 may be soldered or welded to the first circuit board 300*a*.

Figure 4:
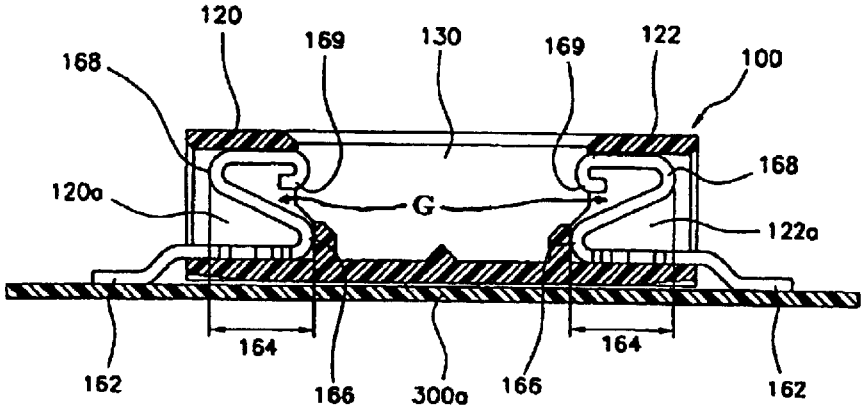
FIG. 4 is a sectional view of a receptacle connector utilized in the connector assembly, of FIG. 2.

The first connector 100 includes a plurality of conductive terminals 160 that are received within the sidewall terminal-receiving cavities 120*a*, 122*a*, one terminal being received within one of the cavities. Each of the terminals 160 includes a lower tail portion 162 and an elastic, flexible contact portion 164 that extends from the tail portion 162. The elastic contact portions 164 are bent at least twice in a zigzag, or "Z" shape, so as to have a lower elastic curved portion 166 that faces the center of the connector housing receptacle and an upper elastic curved portion 168 that faces the exterior of the connector. These two curved portions 166, 168 are spaced apart and separated from each other in the horizontal and vertical direction The lower elastic curved portion 166 is disposed nearer to the tail portion 162 of the terminal 160 than is the upper elastic curved portion 168. In this case, an upper end of the elastic contact portion 164 is bent inwardly (and partially downwardly) to form a contact face, 169 of the receptacle terminal 160. The contact face 169 of the terminal 166 is spaced apart from and separated from the lower curved portion 166 to define a gap "G" (FIG. 4), the function of which is to retain the contact face 224 of the plug connector terminal therebetween. The terminals 160 are inserted one by one in their respective cavities 120*a*, 122*a* of the first connector 100 while the tail portions 162 extend exterior of both of the connector housing sidewalls 120, 122. Further, each of the elastic contact portions 164 extending from the tail portions 162 is bent at least twice in a zigzag shape, so as to form the elastic curved portions 166 and 168, and the upper end of the elastic contact section 164 is bent inward to form a receptacle terminal contact face 169. Importantly, the terminals 160 can be elastically deformed in both the horizontal and the vertical directions by the lower and upper elastic curved portions, 166 and 168.

The second, or plug connector 200, of the connector assembly of FIG. 2 is seen to have a rectangular shape that matches that of the receptacle 130 of the first connector so that the upwardly extending plug portion thereof may be inserted into the receptacle 130 of the first A connector 100. The second connector housing includes a plurality of second holding grooves 202 disposed at opposite ends thereof to permit the plug connector 200 to be fixed to the second circuit board 300*b*. Second holding tabs 210, similar in size and shape to the first holding tabs 140 are wedged into the second holding groove 202 and are used to attach the second connector 200 to the second circuit board 300*b*, such as by soldering or welding.

Figure 3:
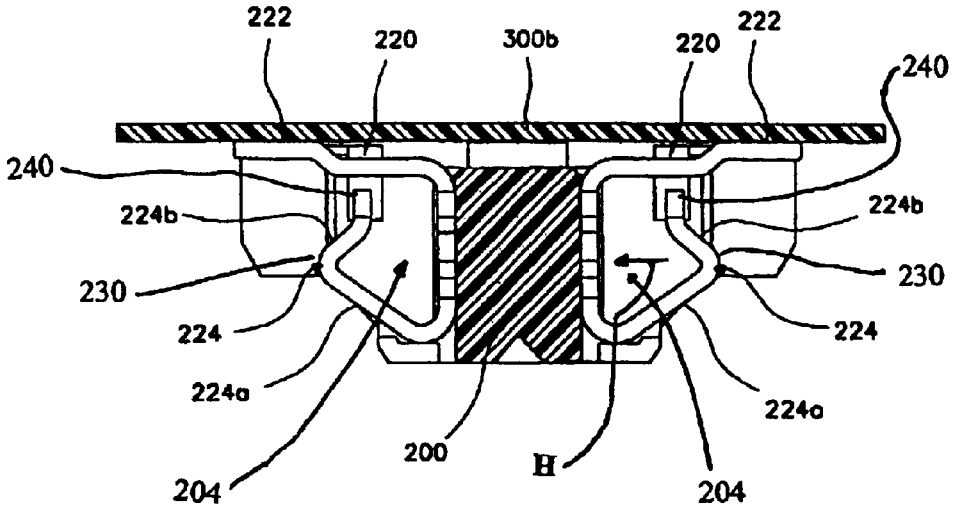
FIG. 3 is a sectional view of a plug connector utilized in the connector assembly of FIG. 2.

The second connector 200 also has a plurality of terminal-receiving cavities 204 arranged in order along both sides of the second connector housing in the lengthwise direction, each of which preferably has a general "U" shape. These cavities 204 are formed in opposing sidewalls of the second connector 200, and they receive conductive terminals 220, which will be described later, that have convex contact portions 230 protruding out of the sidewalls of the second connector housing. Each of the plug connector terminals 220 includes a tail portion 222 at one lower end thereof for attaching the terminals 220 to a second circuit board 300*b*. (FIG. 3.) The remainder of the terminal may be considered as a contact portion 224 and first extends horizontally from the tail portion 222 for a predetermined length and then is preferably is bent upwards or downward, preferably at a right angle thereto, and then is bent again to extend with an inclination, or angle (at 224*a*), in a direction back toward the tail portion 222. The terminals are further bent again inward (at 224*b*) to complete the contact portion 224 of the terminals and to define a convex contact face 230. As seen in the drawings, the contact portion 224 has a general triangular shape, and the inclined surfaces 224*a*, 224*b* extend on opposite sides of what may be considered as a point, or an apex of the terminal 220. Preferably, this apex coincides with the convex contact face 230. The free end 240 of the terminal which is disposed at the end of section 224*b* may engage the housing of the second connector 200 and provide preloading to the terminal 220, if necessary. Each of these terminals 220 are fit into a single terminal-receiving cavity 204 of the second connector 220, and each terminal includes a top bent portion 226 (FIG. 2) that defines the beginning of the triangular shaped contact portion.

The tail portions 222 formed at the lower ends of the terminals 220 are disposed outside the plug connector housing body portion, and the convex contact face 224 extends from the tail portion 222 to protrude out of the body portion in such a manner that it (the convex contact portion 224) may be elastically deformed in the horizontal direction as well as partially in the vertical direction. The convex contact faces 224 of the terminals 220 may be elastically deformed toward portions that form the backbone of the terminals 220, inwardly with respect to the terminal-receiving cavities 204, as illustrated in FIG. 3. It can be seen that the convex contact face 224 is flanked by two inclined or angled surfaces, one being an upper inclined surface 224*a* and the other being a lower inclined surface 224*b*, which cooperatively form a triangular shape, so that the convex contact face 224 extends directly out from the terminal-receiving cavities 204 of the plug connector 200. In this manner, it is positioned so that it can slide on the opposing contact faces 169 of the receptacle terminals 160 for easy and reliable engagement therewith, when the plug connector 200 and the receptacle connector 100 are assembled together.

Figure 5:
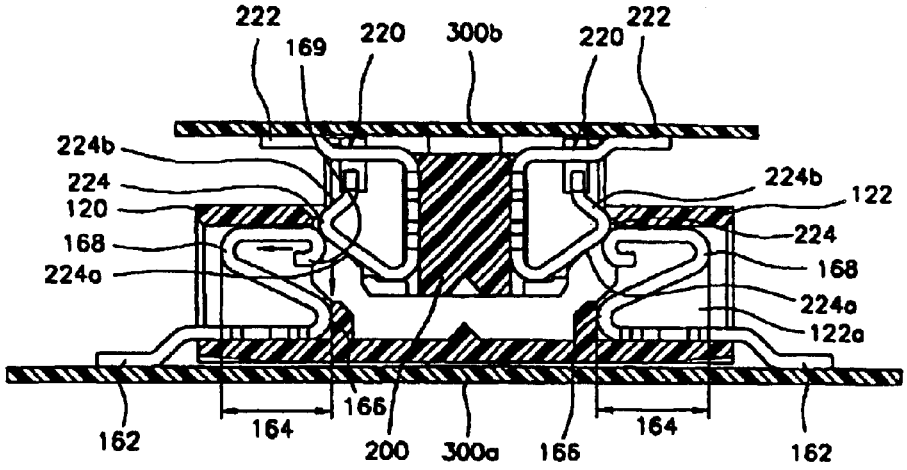
FIG. 5 is a sectional view of a connector assembly of FIG. 2, illustrating the two connectors in an initial alignment, condition and prior to-complete engagement of the two connectors; and, FIG. 6 is the same view as FIG. 5, but illustrating the two connectors of the connector assembly completely engaged with each other.
Figure 6:
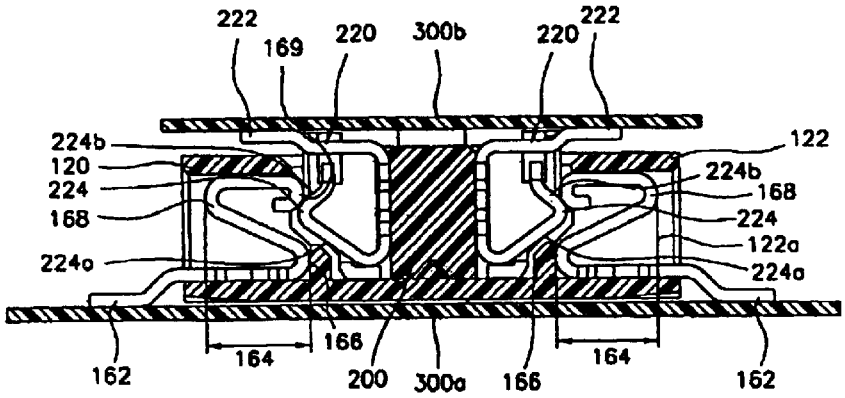

FIG. 5 is a partial sectional view that illustrates, in section, the plug and receptacle connectors 100, 200 aligned with each other prior to engagement, while FIG. 6 illustrates, in section, the two connectors 100, 200 completely assembled together.

The first holding tab 140 of the receptacle connector 100 is soldered to one printed circuit board 300*a*, while the second holding tab 210 of the plug connector 200 is soldered to the other printed circuit board 300*b*. In the orientation of FIG. 5, the plug portion of the plug connector 200 is aligned with the receptacle 130 of the receptacle connector 100, and is pressed slightly into the receptacle 130. The upper inclined surfaces 224*a* of the plug connector terminal convex contact faces 224 first come into contact with the receptacle connector terminal contact faces 169 as illustrated in FIG. 5. In this description, the term "upper" as applied to the plug, connector 200 refers to the orientation of the plug connector when it appears in a position such, as the receptacle connector shown in FIG. 4. It also refers the first surface which contacts the receptacle connector terminals. Thereafter, as the plug connector 200 is inserted further into the receptacle 130, the inclined surface 224*a* of the plug connector terminals move up so that the contact face 224 of the contact section of the terminal in effect, moves horizontally inwardly to toward the center body portion of the plug connector 200 in the direction of the arrow "H" in FIG. 3.

As this occurs, as illustrated in FIG. 6, the convex contact face 224 of the plug connector terminal 220 now rides over the convex contact face 169 of the receptacle connector terminal 160 and becomes disposed between the lower elastic curved portion 166 and the contact face 169 of the receptacle terminal 160, so that the upper inclined surface 224*b* and the contact face 224 of the is in contact with a lower surface of the receptacle connector terminal contact portion 169.

In this case, the entire elastic contact portions 164 of the receptacle connector terminals are elastically deformed outwardly and downwardly until the convex contact portions 224 are located between the lower elastic curved portions 166 and the contact portions 169. Further, the convex contact faces 224 of the plug connector terminals 220 are also elastically deformed in the horizontal direction. The convex contact faces 224 protrude from the contact sections of the plug connector terminals and because these terminals include free ends 240 that may be inserted into cavities for preloading purposes, the contact faces 224 of the plug terminals exert a reliable mating and contact force against the receptacle terminals 166 to ensure that the two connector housings are held together.

As apparent from the above description, in the connector assembly according to the present invention, the connector housing and the assembling body can be fixedly assembled together only by the constructions of the two pins 160 and 220 without a separate locking member formed in the housings of the receptacle or plug connector housing, thus saving on tooling costs and further reducing the overall size of the connector assembly.

In the connector assembly according to the present invention, the connection pins 160 of the connector housing

160 and the plug pins 220 of the assembling body 200 can be elastically deformed, so as to improve stability in the contact between the connection and plug pins 160 and 220 and a contact force for an electric connection between the connection and plug pins.

As described above, a connector assembly for short-circuiting two printed circuit boards according to the present invention has solved the problems of the prior art.

That is, even when an abrupt impact is applied from the exterior, the convex contact portion is not separated due to the engagement between the convex contact portion and the contact portion of each connection pin. Further, no defective contact is caused, since the convex contact portion of each plug pin is in contact with the contact portion of each connection pin by means of resilient forces in both the horizontal and the vertical directions. Additionally, connector assemblies of the present invention permit the receptacle and plug connector housings to be fixed to each other only by way of the configurations of their respective terminals without a separate locking structure, so that the need for complex tooling is dispensed with.

While the preferred embodiment of the invention have been shown and described, it will be apparent to those skilled in the art that changes and modifications may be made therein without departing from the spirit of the invention, the scope of which is defined by the appended claims.

What is claimed is:

1. A board-to-board connector assembly for connecting two printed circuit boards together, comprising:

a first connector housing for fixing to a first one of the two printed circuit boards, the first connector housing including a base and a plurality of sidewalls disposed thereon that define a receptacle of the first connector housing, at least two of the sidewalls including a plurality of first terminal-receiving cavities, each of the first terminal-receiving cavities having a first conductive terminal disposed therein;

each of the first terminals including a tail section and a flexible contact section extending from the tail section, the contact section being bent upon itself at least twice so as to define a plurality of curved portions thereon, two of said curved portions facing inwardly toward said receptacle, said two curved portions being separated by an intervening gap;

a second connector housing for fixing to a second one of said two circuit boards, the second connector housing having a base with a central body portion extending outwardly therefrom to define a plug of said second connector housing that is received within said first connector housing receptacle when said first and second connector housings are mated together, said second connector housing having a plurality of second terminal-receiving cavities, each of the second terminal-receiving cavities having a second conductive terminal disposed therein;

each of said second terminals including a tail section and a flexible contact section extending from the tail section, the second terminal contact section being bent upon itself to form an outwardly extending contact face that extends outwardly from said second connector housing plug, said second terminal contact section being elastically deformable inwardly of said second connector housing plug when said second connector housing plug is inserted into said first connector housing receptacle, whereby said protruding contact faces of said second terminals are received and retained within corresponding gaps of said first terminals.

2. The connector assembly as claimed in claim 1, wherein said second terminal contact section includes a triangular shape with an apex that protrudes outwardly therefrom, said second terminal contact section further including two inclined extents disposed on opposite sides of the apex.

3. The connector assembly as claimed in claim 2, wherein said two inclined extents extend in opposite directions.

4. The connector assembly as claimed in claim 2, wherein said second terminal contact face is disposed at said apex and said apex protrudes outwardly from its terminal-receiving cavity of said second connector housing plug.

5. The connector assembly as claimed in claim 1, wherein each of said first terminals have a Z-shape, and said second terminal two curved portions are separated by vertical gaps.

6. The connector assembly as claimed in claim 5, wherein said first terminal includes two free ends, one of said free ends facing inwardly toward said first connector housing receptacle and being further bent upon itself to define a convex curved contact face of said first terminal, and said second terminal has a pair of inclined surfaces extending out from said second connector housing plug, said first terminal one free end being elastically deformable in horizontal and vertical directions under urging of one of said second terminal inclined surfaces when said second connector housing plug is inserted into said first connector housing receptacle.

7. The connector assembly as claimed in claim 5, wherein said Z-shaped terminals have two free ends extending in opposite directions.

8. The connector assembly as claimed in claim 7, wherein one of said second terminal free ends extends out of said first connector housing to form said terminal tail portion, and the other of said two free ends extends inwardly toward said receptacle, the other free end being bent upon itself to define a curved, convex contact face of said first terminal.

9. The connector assembly as claimed in claim 8, wherein said each of said second terminal contact portions include an upper and lower inclined surface, the upper inclined surface contacting said convex contact face of an opposing first terminal when said second connector housing plug is inserted into said first connector housing receptacle.

10. A connector having terminals improved mating and retention characteristics, the connector being matable with an opposing mating connector and said connector terminals retaining the mating connector in place with said connector, said connector comprising:

a insulative housing, the housing having a plurality of sidewalls extending upwardly and cooperatively defining a receptacle of said connector for receiving a plug of said mating connector, at least two of said sidewalls including a plurality of terminal-receiving cavities disposed therein; and, a plurality of conductive terminals disposed in said connector housing, single terminals being disposed within single terminal-receiving cavities, each of the terminals having a tail portion for connecting to a circuit board, a contact portion facing said receptacle for contacting a corresponding terminal of said mating connector and a flexible body portion interconnecting the tail and contact portions together, the tail portion extending out of said connector housing, said flexible body portion being disposed within said connector housing, said terminal being folded upon itself to form a Z shape, said terminal having two free ends extending in opposite directions, one of the free ends defining said tail portion and the other of said free ends defining said contact portion, the other free end being folded upon itself to define a contact face of said terminal, said terminal two free ends being separated by an intervening gap that receives a contact portion of an opposing terminal of said mating connector.

11. The receptacle connector as claimed in claim 10, wherein said terminal flexible body portion includes an inclined portion extending upwardly from said tail portion to said contact portion, the intervening gap being disposed between said inclined portion and said contact face.

12. The receptacle connector as claimed in claim 10, wherein contact portion and said flexible body portion elastically deforms horizontally and vertically when contacted by the opposing connector of said mating connector.

* * * * *